US005370750A

United States Patent [19]

Novotny et al.

[11] Patent Number: 5,370,750

[45] Date of Patent: Dec. 6, 1994

[54] CORROSION RESISTANT, MARTENSITIC STEEL ALLOY

[75] Inventors: Paul M. Novotny, Mohnton; Thomas J. McCaffrey, Reading; Raymond M. Hemphill, Wyomissing, all of Pa.

[73] Assignee: CRS Holdings, Inc., Wilmington, Del.

[21] Appl. No.: 148,493

[22] Filed: Nov. 8, 1993

[51] Int. Cl.[5] ..... C22C 38/44; C22C 38/46

[52] U.S. Cl. ..... 148/325; 420/69

[58] Field of Search ..... 148/325; 420/69

[56] References Cited

U.S. PATENT DOCUMENTS 1,206,902 12/1916 Patch et al. .
3,295,401 1/1967 Rackoff ..... 148/325
3,355,280 11/1967 Tuffnell et al. .
4,150,978 4/1979 Schlatter et al. ..... 420/69

FOREIGN PATENT DOCUMENTS 933882 8/1963 United Kingdom .
2019887 11/1979 United Kingdom ..... 420/69

OTHER PUBLICATIONS

AISI Yearbook, p. 270, (1943).
Metals Handbook, p. 616, (1939).
"Hot-Rolled and Cold-Finished Corrosion-Resisting Steel Bars", ASTM A276-44T, ASTM Standards, Part 1 (1944).
"High Carbon High Chromium Steels", Transactions American Society for Steel Treating, vol. XV, No. 3, (Mar. 1929).
"The Selection of Tool Steels", *Metal Progress*, pp. 21-33, (1954).
"Stainless Steels", *Metal Progress*, pp. 34-41, (1954).
Alloy Data Sheet, Carpenter Stainless Type 440F (Sep. 1986).
Alloy Data Sheet, Carpenter Stainless Type 440C (Jun. 1987).
Alloy Data Sheet, No. 610 ® Tool Steel (Nov. 1988).

*Primary Examiner*—Deborah Yee
*Attorney, Agent, or Firm*—Dann, Dorfman, Herrell and Skillman

[57] ABSTRACT

A martensitic steel alloy has a unique combination of hardness and corrosion resistance. Broadly stated, the alloy contains, in weight percent, about

| | |
|---|---|
| C | 1.40-1.75 |
| Mn | 0.30-1.0 |
| Si | 0.80 max. |
| P | 0.020 max. |
| S | 0.015 max. |
| Cr | 13.5-18.0 |
| Ni | 0.15-0.65 |
| Mo | 0.40-1.50 |
| V | 1.0 max. |
| N | 0.02-0.08 |

and the balance essentially iron. The alloy is balanced within the stated weight percent ranges such that the ratio %Cr:%C is about 10.0-11.0 and the sum %Ni+%Mn is at least about 0.75. The alloy can be hardened to at least about 60 HRC from a wide range of solution treating temperatures and provides corrosion resistance that is similar to Type 440C alloy.

20 Claims, No Drawings

CORROSION RESISTANT, MARTENSITIC STEEL ALLOY

BACKGROUND OF THE INVENTION

This invention relates to martensitic steel alloys and in particular to such a steel, and an article made therefrom, having a unique combination of hardness and corrosion resistance, and which can be readily hardened from a wide range of solution treating temperatures.

Hitherto, AISI Type 440C alloy has been used in applications, such as bearings and bearing races, where both high hardness and corrosion resistance are required. Type 440C alloy has good corrosion resistance and provides the highest strength and hardness of the known martensitic stainless steels. Although Type 440C alloy is capable of providing a hardness of 60HRC in the as-tempered condition, the alloy provides a case hardness of only about 57–58HRC when it is hardened by induction heating. This limitation on the induction-hardened hardness of Type 440C alloy leaves much to be desired for applications that require a hardness of at least 60HRC.

The high-carbon, high-chromium tool steels, such as AISI Type D2 alloy, contain about 1–2% C and about 12% Cr. These steels provide very high hardness, for example, 60–64HRC, when properly heat treated. However, because of their lower chromium compared to stainless steels such as Type 440C, the high-carbon, high-chromium tool steels are less than desirable for applications that require good corrosion resistance.

In designing a corrosion resistant steel that provides very high hardness, i.e., hardness exceeding 60 HRC, an additional consideration is the heat treating capability of the user of such a steel. In order to facilitate the wide variety of heat treating processes that are used, it is very desirable that a high hardness, corrosion resistant steel be hardenable to its peak hardness over as wide a range of solution treating temperatures as possible.

SUMMARY OF THE INVENTION

The foregoing problems associated with the known alloys are overcome to a large degree in accordance with the present invention which provides a martensitic steel alloy having a unique combination of hardness, strength, and corrosion resistance. In accordance with another aspect of the present invention, there is provided a corrosion resistant, martensitic steel alloy that can be heat treated to very high hardness, e.g., at least 60HRC, from a relatively broad range of solution treating temperatures. The broad and preferred weight percent ranges of the corrosion resistant, martensitic steel alloy according to the present invention are summarized in Table 1 below.

TABLE 1

| | Broad | Preferred |
|---|---|---|
| C | 1.40–1.75 | 1.50–1.65 |
| Mn | 0.30–1.0 | 0.45–0.60 |
| Si | 0.80 max. | 0.30–0.45 |
| P | 0.020 max. | 0.020 max. |
| S | 0.015 max. | 0.015 max. |
| Cr | 13.5–18.0 | 15.5–16.5 |
| Ni | 0.15–0.65 | 0.25–0.45 |
| Mo | 0.40–1.50 | 0.75–0.90 |
| V | 1.0 max. | 0.40–0.50 |
| N | 0.02–0.08 | 0.04–0.06 |

The balance of the alloy is essentially iron, apart from the usual impurities. The elements C and Cr are controlled within their respective weight percent ranges such that the ratio %Cr:%C is about 10.0 to 11.0. Furthermore, the composition of this alloy is balanced such that the sum of %Ni+%Mn is at least about 0.75. Here and throughout this application the term "percent" or "%" means percent by weight, unless otherwise indicated.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the ranges can be used with one or more of the other ranges for the remaining elements. In addition, a minimum or maximum for an element of one preferred embodiment can be used with the minimum or maximum for that element from another preferred embodiment.

DETAILED DESCRIPTION

The corrosion resistant, martensitic steel alloy according to the present invention contains carbon and chromium in controlled proportions to provide the unique combination of hardness and corrosion resistance that are characteristic of this alloy. Carbon contributes to the high, as-quenched hardness of this alloy and so at least about 1.40%, better yet at least about 1.50%, carbon is present in this alloy. Too much carbon adversely affects the corrosion resistance of this alloy because when too much carbon is present, a significant amount of chromium-bearing carbides precipitate out of the solid solution, thereby depleting the matrix of chromium. Accordingly, not more than about 1.75%, preferably not more than about 1.65%, carbon is present in this alloy. For best results, this alloy contains about 1.58–1.63% carbon.

At least about 13.5%, preferably at least about 15.5% chromium is present in this alloy to benefit the alloy's corrosion resistance. Too much chromium adversely affects the hardness response of this alloy and restricts the solution treatment temperature to an undesirably narrow range. Accordingly, this alloy contains not more than about 18.0%, preferably not more than about 16.5%, chromium.

Within the foregoing weight percent ranges, the amounts of carbon and chromium present in this alloy are controlled so that the alloy provides an as-quenched hardness of at least 60HRC when quenched from a wide range of solution treating temperatures, in combination with corrosion resistance that is at least as good as that provided by Type 440C alloy. More specifically, the elements carbon and chromium are balanced so that the ratio of chromium to carbon (%Cr:%C) in this alloy is at least about 10.0 and preferably not more than about 11.0.

Nitrogen, like carbon, contributes to the hardness and strength of the alloy. However, nitrogen does not adversely affect the corrosion resistance of this alloy to the same degree as carbon. Accordingly, there is at least about 0.02%, preferably at least about 0.04%, nitrogen in this alloy. This alloy preferably contains not more than about 0.08% and better yet, not more than about 0.06% nitrogen when conventionally melted and cast. However, the alloy can contain more nitrogen when made by such processes as superatmospheric pressure melting or powder metallurgy.

Manganese and nickel are present in this alloy because they contribute to the deep hardenability provided by the alloy without adversely affecting the alloy's resistance to corrosion. Manganese and nickel also benefit the responsiveness of this alloy to hardening heat treatments by broadening the solution temperature range and by increasing the weight percent range of carbon over which a fully hardened alloy structure can be obtained. Manganese also benefits the solubility of nitrogen in this alloy, thereby indirectly benefitting the hardness response of the alloy. If too little nickel is present in this alloy, the solution temperature range for obtaining a hardness of at least 60HRC is undesirably narrow, particularly when induction heating techniques are employed. For the foregoing reasons, at least about 0.30%, preferably at least about 0.45%, manganese, and at least about 0.25% nickel are present in this alloy. For best results, the combined amount of manganese and nickel (%Mn+%Ni) in this alloy is at least about 0.75% and preferably at least about 0.85%.

Too much manganese adversely affects the as-quenched hardness of this alloy, particularly when the alloy is solution treated at a temperature of about 1850–2050 F. Accordingly, this alloy contains not more than about 1.0%, and preferably not more than about 0.60%, manganese.

There is little benefit to having a large amount of nickel in this alloy. While up to about 0.65% nickel can be present in the alloy, preferably not more than about 0.45% nickel is present.

A small but effective amount of vanadium, e.g., at least about 0.01%, is present in this alloy because vanadium benefits the good hardenability of the alloy. Better yet, at least about 0.25%, preferably, at least about 0.40% vanadium is present in this alloy to provide a hardness of at least 60HRC when the alloy is solution treated at a temperature greater than about 2000 F. Vanadium also contributes to the good wear resistance of this alloy by combining with some of the carbon to form vanadium carbides. However, the formation of excessive amounts of vanadium carbides depletes the alloy matrix of carbon, thereby adversely affecting the as-quenched hardness of this alloy. Accordingly, not more than about 1.0% and preferably not more than about 0.50%, vanadium is present in this alloy.

At least about 0.40%, preferably at least about 0.75%, molybdenum is present in this alloy because molybdenum benefits the hardness response of the alloy, particularly when it is solution treated in the temperature range of 1850–2050 F. Too much molybdenum adversely affects the hardness response when the alloy is solution treated at 2000 F. and above, such that the alloy does not provide an as-quenched hardness of at least 60HRC. Therefore, not more than about 1.50%, preferably not more than about 0.90%, molybdenum is present in this alloy.

Cobalt can be present in this alloy in substitution for some of the nickel. Preferably, the alloy contains not more than about 0.10% cobalt. If desired, free machining additives such as sulfur, selenium, or the like, alone or in combination, can be included in this alloy to improve its machinability. Provided however, that the amount of any or all of such free machining additives is restricted to an amount that does not adversely affect the hardness response or corrosion resistance of the alloy.

The balance of the alloy is iron and the usual impurities found in commercial grades of alloys intended for the same or similar service or use. The amounts of such elements are controlled so as not to adversely affect the unique combination of hardness and corrosion resistance that is characteristic of this alloy. For example, this alloy preferably contains not more than about 0.020% phosphorus, not more than about 0.015% sulfur, not more than about 0.01% aluminum, not more than about 0.01% titanium, and not more than about 0.05% tungsten.

This alloy can be prepared using conventional melting and casting techniques. While no special melting process is required, the alloy is preferably arc melted and then refined using the argon-oxygen decarburization (AOD) process. As indicated above, this alloy can be melted under superatmospheric pressure or made by powder metallurgy techniques when it is desired to include greater amounts of nitrogen in the alloy than is practicable with arc melting. This alloy is also suitable for continuous casting processes.

In the as-cast condition, the alloy is preferably hot worked from about 2150 F. When the alloy has been partially hot-worked from the as-cast condition, it can be further hot worked from about 2100 F. Preferably, the alloy is not worked below about 1800 F. When initially hot working this alloy from the as-cast condition, it is preferred that the percent reduction per pass be relatively small. Larger reductions can be taken after the alloy has been partially hot-worked.

The alloy according to the present invention is hardenable from a wide range of solution treating temperatures. To attain a hardness of at least 60HRC, the alloy is hardened by heating to a solution treating temperature in the range of about 1800–2050 F., preferably about 1850–1950 F., in order to substantially fully austenitize the alloy. While the alloy can be heated to the solution temperature by any conventional technique, induction heating has been used with good results. After solution treatment the alloy is preferably quenched in air. This alloy can be through-hardened and it is also amenable to case-hardening. When desired, the alloy can be tempered after it is hardened. Although this alloy can be tempered at 350 F. or 950 F., the alloy is preferably tempered at about 350 F. to provide the best combination of hardness and toughness. Tempering of this alloy at 950 F. results in the formation of $(Fe,Cr)_7C_3$ carbides which depletes the matrix of chromium and adversely affects the corrosion resistance of the alloy. Therefore, tempering at 950 F. provides good results where less than optimum corrosion resistance can be tolerated.

EXAMPLE

To demonstrate the unique combination of hardness and corrosion resistance provided by the alloy according to the present invention, three test heats were prepared and tested: Heat 85, exemplifying Type 440C. alloy, Heat 87, exemplifying Type D2 alloy, and a third exemplifying the alloy according to the present invention. The weight percent compositions of the three heats are shown in Table 1 below.

TABLE 1

| Element | Heat 85 | Heat 87 | Invention |
|---|---|---|---|
| Carbon | 0.99 | 1.54 | 1.54 |
| Manganese | 0.39 | 0.55 | 0.54 |
| Silicon | 0.66 | 0.37 | 0.37 |
| Phosphorus | 0.006 | 0.007 | 0.007 |
| Sulfur | 0.006 | 0.005 | 0.005 |
| Chromium | 16.98 | 11.12 | 16.02 |

TABLE 1-continued

| Element | Heat 85 | Heat 87 | Invention |
|---|---|---|---|
| Nickel | <0.01 | 0.24 | 0.25 |
| Molybdenum | 0.51 | 0.84 | 0.84 |
| Vanadium | — | 0.82 | 0.83 |
| Nitrogen | 0.026 | 0.039 | 0.049 |
| Iron | Bal. | Bal. | Bal. |

Each heat was vacuum induction melted (VIM) and split-cast into two (2) 2.75in. square ingots. All of the ingots were vermiculite cooled and then stress relieved at 1400 F. for 4 hours. One of the ingots of each heat was heated to 2050 F., forged to a 1.25in. square cross-section, reheated to 2050 F., and then one half of the bar was forged to a 0.75in. square cross-section. The forged bars were stress relieved at 400 F. for 4 hours and then annealed. The second ingot of each heat was forged from 2050 F. to a second bar 0.625in. thick, cooled in vermiculite, and then stress relieved and annealed in the same manner as the first bar.

Cube samples measuring 0.5in. on a side were machined from the first and second bars of each heat for hardness testing. The test cubes were heat treated by heating individual cubes from each bar at one of a series of solution treatment temperatures and then cooling the cubes in air. The solution treatment was conducted in salt and the samples were maintained at temperature for 25 minutes. A duplicate set of cubes was solution treated in the same manner, but cooled in vermiculite to provide a slower cooling rate relative to air cooling.

Shown in Table 2A are the results of room temperature hardness tests on the air-cooled samples. The results for the vermiculite cooled samples are shown in Table 2B. The test results (As-quenched Hardness) are given as Rockwell C hardness numbers (HRC) for each test heat. Each test result represents the average of five (5) readings taken in accordance with standard Rockwell hardness testing procedures.

TABLE 2A

| | (Air cooled) As-quenched Hardness (HRC) | | |
|---|---|---|---|
| Sol. Temp. | Heat 85 | Heat 87 | Invention |
| 1750 F | 52.7 | 59.7 | 56.0 |
| 1820 F | 55.5 | 63.5 | 58.7 |
| 1850 F | 57.0 | 63.7 | 60.7 |
| 1880 F | 57.5 | 64.3 | 62.0 |
| 1950 F | 59.8 | 63.0 | 62.0 |
| 2000 F | 59.8 | 60.8 | 60.8 |

TABLE 2B

| | (Vermiculite cooled) As-quenched Hardness (HRC) | | |
|---|---|---|---|
| Sol. Temp. | Heat 85 | Heat 87 | Invention |
| 1750 F | 21.7 | 36.7 | 26.8 |
| 1820 F | 76.2 | 61.2 | 56.0 |
| 1850 F | 24.3 | 61.8 | 58.8 |
| 1880 F | 24.0 | 61.8 | 59.0 |
| 1950 F | 26.3 | 44.8 | 59.0 |
| 2000 F | 47.2 | 60.5 | 60.2 |

The date of Tables 2A and 2B show the superior as-quenched hardness of the claimed alloy compared to Type 440C alloy and that the as-quenched hardness of the claimed alloy approaches the very high as-quenched hardness of Type D2 alloy. Moreover, the data of Table 2B show that the as-quenched hardness provided by the claimed alloy is not significantly diminished when the alloy is cooled relatively more slowly from a solution treating temperature of 1820 F. or above. The latter result indicates that the claimed alloy provides high as-quenched hardness over a range of cooling rates that are slower than air cooling.

Additional cube samples of each heat were solution treated and quenched as described above and then tempered at 400 F., 800 F., 950 F., and 1100 F., respectively, for one hour in order to perform tempering studies. Further samples of each heat were solution treated at 1450 F. for 24 hours for the tempering study. Shown in Tables 3A and 3B are the results of room temperature hardness tests on the tempered samples for each of the tempering temperatures. The results for the air cooled samples are shown in Table 3A and the results for the vermiculite cooled samples are shown in Table 3B. The test results (As-tempered Hardness) are given as Rockwell C hardness numbers (HRC) for each test heat. Each test result represents the average of five (5) readings taken in accordance with standard Rockwell hardness testing procedures.

TABLE 3A

| | | (Air-cooled) As-tempered Hardness (HRC) | | | | |
|---|---|---|---|---|---|---|
| Sol. Temp. | Ht. | 400 F | 800 F | 950 F | 1100 F | 1450 F |
| 1750 | 85 | 52.5 | 52.0 | 51.8 | 36.2 | 20.7 |
| | 87 | 58.5 | 56.0 | 55.0 | 47.0 | 21.5 |
| | Inv. | 56.0 | 55.0 | 55.0 | 43.7 | 27.7 |
| 1820 | 85 | 54.5 | 55.2 | 54.5 | 38.7 | 21.0 |
| | 87 | 60.5 | 57.8 | 58.0 | 49.3 | 20.3 |
| | Inv. | 57.3 | 57.0 | 57.3 | 46.2 | 27.3 |
| 1850 | 85 | 55.2 | 55.2 | 54.5 | 39.2 | 20.8 |
| | 87 | 61.5 | 58.2 | 58.5 | 49.8 | 21.2 |
| | Inv. | 58.5 | 57.3 | 58.0 | 46.5 | 27.3 |
| 1880 | 85 | 55.0 | 56.2 | 55.7 | 40.0 | 20.5 |
| | 87 | 61.0 | 58.5 | 59.7 | 51.2 | 22.0 |
| | Inv. | 59.5 | 58.0 | 58.5 | 47.7 | 27.7 |
| 1950 | 85 | 57.5 | 56.2 | 56.8 | 41.3 | 21.0 |
| | 87 | 60.5 | 57.3 | 60.5 | 52.0 | 19.3 |
| | Inv. | 60.0 | 57.0 | 60.2 | 48.2 | 29.7 |
| 2000 | 85 | 57.7 | 56.1 | 57.8 | 43.7 | 21.8 |
| | 87 | 58.2 | 55.4 | 58.8 | 57.7 | 28.3 |
| | Inv. | 58.9 | 57.0 | 59.2 | 50.3 | 31.0 |

TABLE 3B

| | | (Vermiculite cooled) As-tempered Hardness (HRC) | | | | |
|---|---|---|---|---|---|---|
| Sol. Temp. | Ht. | 400 F | 800 F | 950 F | 1100 F | 1450 F |
| 1750 | 85 | 21.0 | 42.0 | 43.0 | 19.8 | 16.5 |
| | 87 | 37.5 | 49.2 | 50.2 | 42.8 | 20.2 |
| | Inv. | 25.8 | 26.5 | 27.2 | 26.5 | 38.2 |
| 1820 | 85 | 25.8 | 46.0 | 23.2 | 29.3 | 18.2 |
| | 87 | 59.5 | 57.2 | 48.5 | 30.2 | 16.5 |
| | Inv. | 55.5 | (1) | 57.2 | 44.2 | 28.0 |
| 1850 | 85 | 23.7 | 40.2 | 23.7 | 34.2 | 17.5 |
| | 87 | 59.7 | 57.2 | 58.0 | 49.0 | (1) |
| | Inv. | 58.2 | 56.0 | 57.2 | 45.0 | 27.5 |
| 1880 | 85 | 23.2 | 25.2 | 24.8 | 26.7 | 16.2 |
| | 87 | 59.5 | 51.2 | 55.0 | 34.3 | 16.2 |
| | Inv. | 57.3 | 57.0 | 57.2 | 46.7 | 27.3 |
| 1950 | 85 | 25.7 | 43.2 | 25.7 | 28.2 | 19.2 |
| | 87 | 42.0 | 56.7 | 59.2 | 51.2 | 18.0 |
| | Inv. | 57.5 | 57.5 | 59.2 | 45.8 | 28.7 |
| 2000 | 85 | 48.1 | 45.8 | 52.4 | 39.7 | 18.8 |
| | 87 | 60.3 | 57.0 | 60.0 | 51.9 | 25.8 |
| | Inv. | 58.5 | 58.5 | 59.8 | 47.5 | 31.0 |

(1) Not tested.

The data in Tables 3A and 3B show the superior temper resistance of the claimed alloy compared to Type 440C alloy when hardened from 1850–2000 F., the preferred commercial heat treating range. The data also show that the tempered hardness of the claimed alloy approaches, and at some tempering temperatures even exceeds, the as-tempered hardness of Type D2 alloy. Those results indicate that the claimed alloy retains a significant amount of its peak or as-quenched hardness after being tempered.

Quadruplicate cone samples were machined from the 1.25in. bars of each of the test heats for corrosion testing. The cone samples of Heat 85 were heat treated in salt at 1925 F. for 25 minutes, the preferred commercial heat treatment, and the cone samples of Heat 87 and the heat of the claimed alloy were heat treated at 1850 F. in salt for 25 minutes. All of the cone samples were cooled in air from the solution temperature. Half of the cone samples of each heat were passivated by immersion in a solution containing 50% by volume $HNO_3$ at 130 F. for 30 minutes. All of the cone samples were tested for corrosion resistance in a 95% relative humidity environment at 95 F. (35C.). The results of the humidity test for the passivated and non-passivated samples are shown in Tables 4A and 4B respectively. The data include a rating (Corrosion Rating) of the degree of corrosion after 1h, 8h, 24h, 72h, and 200h for each of the duplicate samples of each heat. The rating system used is as follows: 1=no rusting; 2=1 to 3 rust spots; 3=approx. 5% of surface rusted; 4=5 to 10% of surface rusted; 5=10 to 20% of surface rusted; 6=20 to 40% of surface rusted; 7=40 to 60% of surface rusted; 8=60 to 80% of surface rusted; and 9=more than 80% of surface rusted. Only the conical surface of each cone was evaluated for rust.

TABLE 4A

| | (Passivated) Corrosion Rating | | |
|---|---|---|---|
| Test Time | Ht. 85 | Ht. 87 | Inv. |
| 1 h | 3,3 | 3,3 | 3,3 |
| 8 h | 3,3 | 3,3 | 3,3 |
| 24 h | 4,4 | 3,3 | 3,3 |
| 72 h | 4,4 | 3,3 | 3,4 |
| 200 h | 4,4 | 4,4 | 4,4 |

TABLE 4B

| | (Non-passivated) Corrosion Rating | | |
|---|---|---|---|
| Test Time | Ht. 85 | Ht. 87 | Inv. |
| 1 h | 3,3 | 4,3 | 3,3 |
| 8 h | 3,3 | 5,4 | 3,3 |
| 24 h | 3,4 | 6,5 | 3,3 |
| 72 h | 3,4 | 6,5 | 3,4 |
| 200 h | 4,4 | 6,6 | 4,5 |

Although the data of Table 4A does not show any significant difference in corrosion resistance among the tested heats in the passivated condition, the data in Table 4B do show that in the non-passivated condition the claimed alloy has superior corrosion resistance to Type D2 alloy. The data further show that the claimed alloy has corrosion resistance that is about the same as Type 440C alloy in either the passivated or non-passivated condition. When the data of Tables 2A, 2B, 3A, 3B, 4A, and 4B are considered as a whole, it is clear that the claimed alloy provides a superior combination of hardness and corrosion resistance compared to the known alloys.

It can be seen from the foregoing description and the accompanying examples that the alloy according to the present invention provides a unique combination of hardness and corrosion resistance well suited to a wide variety of uses where an exceptional combination of hardness and corrosion resistance is required. In particular, this alloy is suitable for use in bearings and bearing races, cutlery, needle valves, ball check valves, valve seats, pump parts, ball studs, bushings, or wear-resistant textile components. Because of this alloy's very high hardness, it is also suitable for use in tools, dies, rolls, punches, or cutters.

The terms and expressions which have been employed herein are used as terms of description and not of limitation. There is no intention in the use of such terms and expressions to exclude any equivalents of the compositions described or the constituents thereof. It is recognized that various modifications are possible within the scope of the invention claimed.

What is claimed is:

1. A corrosion resistant, martensitic steel alloy consisting essentially of, in weight percent, about:

| | |
|---|---|
| C | 1.40–1.75 |
| Mn | 0.30–1.0 |
| Si | 0.80 max. |
| P | 0.020 max. |
| S | 0.015 max. |
| Cr | 13.5–18.0 |
| Ni | 0.15–0.65 |
| Mo | 0.40–1.50 |
| V | 1.0 max. |
| N | 0.02–0.08 |

and the balance essentially iron, wherein the ratio %Cr:%C is about 10.0 to 11.0 and the sum %Ni+%Mn is at least about 0.75.

2. An alloy as set forth in claim 1 which contains at least about 0.25% vanadium.

3. An alloy as set forth in claim 1 which contains at least about 15.5% chromium.

4. An alloy as set forth in claim 2 which contains at least about 1.50% carbon.

5. An alloy as set forth in claim 1 which contains at least about 0.35% nickel.

6. An alloy as set forth in claim 5 which contains at least about 0.45% manganese.

7. An alloy as set forth in claim 1 wherein the sum %Ni+%Mn is at least about 0.85.

8. An alloy as set forth in claim 1 containing at least about 0.04% nitrogen.

9. An alloy as set forth in claim 1 containing at least about 0.75% molybdenum.

10. A corrosion resistant, martensitic steel alloy consisting essentially of, in weight percent, about:

| | |
|---|---|
| C | 1.50–1.75 |
| Mn | 0.45–1.0 |
| Si | 0.30–0.80 |
| P | 0.020 max. |
| S | 0.015 max. |
| Cr | 15.5–18.0 |
| Ni | 0.25–0.65 |
| Mo | 0.75–1.50 |
| V | 0.25–1.0 |
| N | 0.04–0.08 |

and the balance essentially iron, wherein the ratio %Cr:%C is about 10.0 to 11.0 and the sum %Ni+%Mn is at least about 0.75.

11. An alloy as set forth in claim 10 containing not more than about 1.65% carbon.

12. An alloy as set forth in claim 11 containing not more than about 16.5% chromium.

13. An alloy as set forth in claim 10 containing not more than about 0.45% nickel.

14. An alloy as set forth in claim 13 containing not more than about 0.60% manganese.

15. An alloy as set forth in claim 14 wherein the sum %Ni+%Mn is at least about 0.85.

16. A corrosion resistant, martensitic steel alloy consisting essentially of, in weight percent, about:

| | |
|---|---|
| C | 1.50–1.65 |
| Mn | 0.45–0.65 |
| Si | 0.30–0.45 |
| P | 0.020 max. |
| S | 0.015 max. |
| Cr | 15.5–16.5 |
| Ni | 0.25–0.45 |
| Mo | 0.75–0.90 |
| V | 0.40–0.50 |
| N | 0.04–0.06 |

and the balance essentially iron, wherein the ratio %Cr:%C is about 10.0 to 11.0 and the sum %Ni+%Mn is at least about 0.85.

17. An article formed of an alloy consisting essentially of, in weight percent, about:

| | |
|---|---|
| C | 1.40–1.75 |
| Mn | 0.30–1.0 |
| Si | 0.80 max. |
| P | 0.020 max. |
| S | 0.015 max. |
| Cr | 13.5–18.0 |
| Ni | 0.15–0.65 |
| Mo | 0.40–1.50 |
| V | 1.0 max. |
| N | 0.02–0.08 |

and the balance essentially iron, wherein the ratio %Cr:%C is about 10.0 to 11.0 and the sum %Ni+%Mn is at least about 0.75.

18. An article as set: forth in claim 17 having a hardness of at least about 60 on the Rockwell C scale (HRC).

19. An article as set forth in claim 18 which has been solution heat treated at about 1850–2050 F.

20. An article as set: forth in claim 19 which has been heated to the solution treating temperature by induction heating.

* * * * *